US010724521B2

(12) United States Patent
Choi et al.

(10) Patent No.: US 10,724,521 B2
(45) Date of Patent: Jul. 28, 2020

(54) SCROLL COMPRESSOR WITH WRAP HAVING GRADUALLY DECREASING THICKNESS

(71) Applicant: LG ELECTRONICS INC., Seoul (KR)

(72) Inventors: Jungsun Choi, Seoul (KR); Howon Lee, Seoul (KR); Cheolhwan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 337 days.

(21) Appl. No.: 15/491,009

(22) Filed: Apr. 19, 2017

(65) Prior Publication Data

US 2017/0306953 A1 Oct. 26, 2017

(30) Foreign Application Priority Data

Apr. 26, 2016 (KR) ..... 10-2016-0051038

(51) Int. Cl.
*F03C 2/00* (2006.01)
*F03C 4/00* (2006.01)
(Continued)

(52) U.S. Cl.
CPC ..... *F04C 18/0269* (2013.01); *F01C 21/102* (2013.01); *F04C 18/0215* (2013.01);
(Continued)

(58) Field of Classification Search
CPC ..... F04C 29/0085; F04C 29/0057; F04C 29/021; F04C 29/023; F04C 29/025;
(Continued)

(56) References Cited

U.S. PATENT DOCUMENTS 3,874,827 A * 4/1975 Young ..... F04C 18/0215 418/55.2
4,886,433 A 12/1989 Maier
(Continued)

FOREIGN PATENT DOCUMENTS

CN 1074276 7/1993
CN 1458422 11/2003
(Continued)

OTHER PUBLICATIONS

Chinese Office Action dated Sep. 27, 2018 with English Translation.
(Continued)

*Primary Examiner* — Theresa Trieu
(74) *Attorney, Agent, or Firm* — Ked & Associates LLP

(57) ABSTRACT

A scroll compressor is provided that may include a casing; a drive motor provided at an inner space of the casing; a rotational shaft coupled to a rotor of the drive motor, and rotated together with the rotor; a frame provided below the drive motor; a fixed scroll provided below the frame, and having a fixed wrap; and an orbiting scroll provided between the frame and the fixed scroll, having an orbiting wrap so as to form a compression chamber including a suction chamber, an intermediate pressure chamber, and a discharge chamber, by being engaged with the fixed wrap. In a state in which a center of the fixed scroll and a center of the orbiting scroll are substantially the same, an interval between the fixed wrap and the orbiting wrap gradually increases towards the suction chamber from the discharge chamber.

14 Claims, 7 Drawing Sheets

(51) Int. Cl.

| | |
|---|---|
| ***F04C 18/00*** | (2006.01) |
| ***F04C 18/02*** | (2006.01) |
| ***F01C 21/10*** | (2006.01) |
| *F04C 23/00* | (2006.01) |
| *F04C 29/02* | (2006.01) |

(52) U.S. Cl.
CPC ..... *F04C 23/008* (2013.01); *F04C 29/023* (2013.01); *F04C 29/025* (2013.01); *F04C 2240/603* (2013.01); *F05C 2201/02* (2013.01); *F05C 2201/021* (2013.01); *F05C 2201/0439* (2013.01)

(58) Field of Classification Search
CPC ..... F04C 2240/30; F04C 2240/60; F04C 2240/603; F04C 2240/809; F04C 18/0215; F04C 18/0246; F04C 18/0253; F04C 18/0269; F04C 23/008; F05C 2201/021; F05C 2201/02; F05C 2201/0436; F05C 2201/0439; F01C 21/102
USPC ..... 418/55.1–55.6, 57, 88, 94, 97–99, 102, 418/178–179
See application file for complete search history.

(56) References Cited

U.S. PATENT DOCUMENTS

| | | | | |
|---|---|---|---|---|
| 5,151,020 | A | 9/1992 | Mori et al. | |
| 6,302,665 | B1 * | 10/2001 | Esumi | F04C 2230/91 418/178 |
| 2007/0212244 | A1 * | 9/2007 | Futagami | F04C 18/0269 418/55.2 |
| 2011/0103991 | A1 * | 5/2011 | Hwang | F04C 18/0269 418/55.2 |
| 2013/0004354 | A1 | 1/2013 | Kiem et al. | |
| 2013/0121866 | A1 * | 5/2013 | Jang | F04C 18/0215 418/55.5 |
| 2015/0337838 | A1 * | 11/2015 | Sung | F04C 18/0215 418/55.3 |
| 2016/0040672 | A1 | 2/2016 | Lee et al. | |
| 2016/0053759 | A1 * | 2/2016 | Choi | F04C 18/0269 418/55.2 |

FOREIGN PATENT DOCUMENTS

| | | |
|---|---|---|
| CN | 1829862 | 9/2006 |
| CN | 103032329 | 4/2013 |
| CN | 103459051 | 12/2013 |
| CN | 105370571 | 3/2016 |
| EP | 0 049 495 | 4/1982 |
| EP | 2 813 706 | 12/2014 |
| JP | H11 257259 | 9/1999 |
| JP | 2008-163895 | 7/2008 |
| JP | 2009-174406 | 8/2009 |
| JP | 2014-218934 | 11/2014 |
| KR | 1995-0033100 | 12/1995 |
| KR | 10-2016-0022146 | 2/2016 |

OTHER PUBLICATIONS

European Search Report dated Aug. 4, 2017 issued in Application No. 17165727.3.
International Search Report dated Jun. 7, 2017.
Chinese Office Action dated Jun. 19, 2019 with English Translation.
U.S. Appl. No. 16/693,467, filed Nov. 25, 2019, Examiner to be assigned.
European Search Report dated May 15, 2020 issued in Application No. 20160652.2.

* cited by examiner

SCROLL COMPRESSOR WITH WRAP HAVING GRADUALLY DECREASING THICKNESS

CROSS-REFERENCE TO RELATED APPLICATION(S)

Pursuant to 35 U.S.C. § 119(a), this application claims the benefit of an earlier filing date of and the right of priority to Korean Application No. 10-2016-0051038, filed in Korea on Apr. 26, 2016, the contents of which are incorporated by reference herein in its entirety.

BACKGROUND

1. Field

A scroll compressor is disclosed herein.

2. Background

Generally, a scroll compressor is being widely used in air conditioners, for example, in order to compress a refrigerant, owing to its advantages that a compression ratio is relatively higher than that of other types of compressors, and a stable torque is obtainable as processes for suction, compressing, and discharging a refrigerant are smoothly performed. A behavior characteristic of the scroll compressor is determined by a non-orbiting wrap (hereinafter, referred to as a "fixed wrap") of a non-orbiting scroll (hereinafter referred to as a "fixed scroll") and an orbiting wrap of an orbiting scroll. The fixed wrap and the orbiting wrap may have any shape, but they generally have a shape of an involute curve for easy processing. The involute curve means a curved line corresponding to a moving path drawn by the end of a thread when the thread wound around a basic circle having any radius is unwound. In a case of using such an involute curve, the fixed wrap and the orbiting wrap stably perform a relative motion since they have a constant thickness, thereby forming a compression chamber to compress a refrigerant.

The compression chamber of the scroll compressor has a suction chamber at an outer side and a discharge chamber at an inner side, as a volume of the compression chamber is reduced towards the inner side from the outer side. Thus, the fixed scroll and the orbiting scroll form a high temperature towards the inner side, due to compression heat. Especially, in a case of a scroll compressor which satisfies a high temperature and a high compression ratio, an inner compression chamber has a much higher temperature than an outer compression chamber.

Accordingly, the fixed scroll and the orbiting scroll have a largest thermal expansion ratio at a central region, and a thermal expansion ratio is gradually reduced towards an edge region. However, a total thermal expansion amount is largest at the edge region, as a thermal expansion amount generated from the central region is accumulated at the edge region. Thus, the fixed wrap of the fixed scroll and the orbiting wrap of the orbiting scroll may partially contact each other at the edge region, resulting in a frictional loss. This may cause abrasion of a side surface of the fixed wrap or a side surface of the orbiting wrap, resulting in leakage of a compressed refrigerant. Especially, when the fixed scroll and the orbiting scroll are formed of different materials, for instance, when the fixed scroll is formed of cast-iron and the orbiting scroll is formed of a material having a light weight and a high thermal expansion coefficient, for example, aluminum, the orbiting scroll has a larger thermal deformation than the fixed scroll. This may significantly increase a frictional loss or abrasion.

Further, there is a limitation in selecting materials of the fixed scroll and the orbiting scroll. In a case of driving the scroll compressor with a high compression ratio, a larger amount of compression heat may be generated to increase a deformation amount of the orbiting scroll. This may cause a limitation in designing the scroll compressor with a high compression ratio.

BRIEF DESCRIPTION OF THE DRAWINGS

Embodiments will be described in detail with reference to the following drawings in which like reference numerals refer to like elements, and wherein.

DETAILED DESCRIPTION

Hereinafter, a scroll compressor according to embodiments will be explained with reference to the attached drawings. For reference, the scroll compressor according to embodiments is to reduce a frictional loss and abrasion between a fixed wrap and an orbiting wrap due to thermal expansion, by controlling an interval between the fixed wrap and the orbiting wrap. Thus, the embodiments may be applied to any type of scroll compressor having a fixed wrap and an orbiting wrap. However, for convenience, a lower compression type scroll compressor will be explained where a compression part is disposed below a motor part, more specifically, a scroll compressor where a rotational shaft is overlapped with an orbiting wrap on a same plane. Such a scroll compressor is appropriate to be applied to a refrigerating cycle of a high temperature and a high compression ratio.

Figure 1:
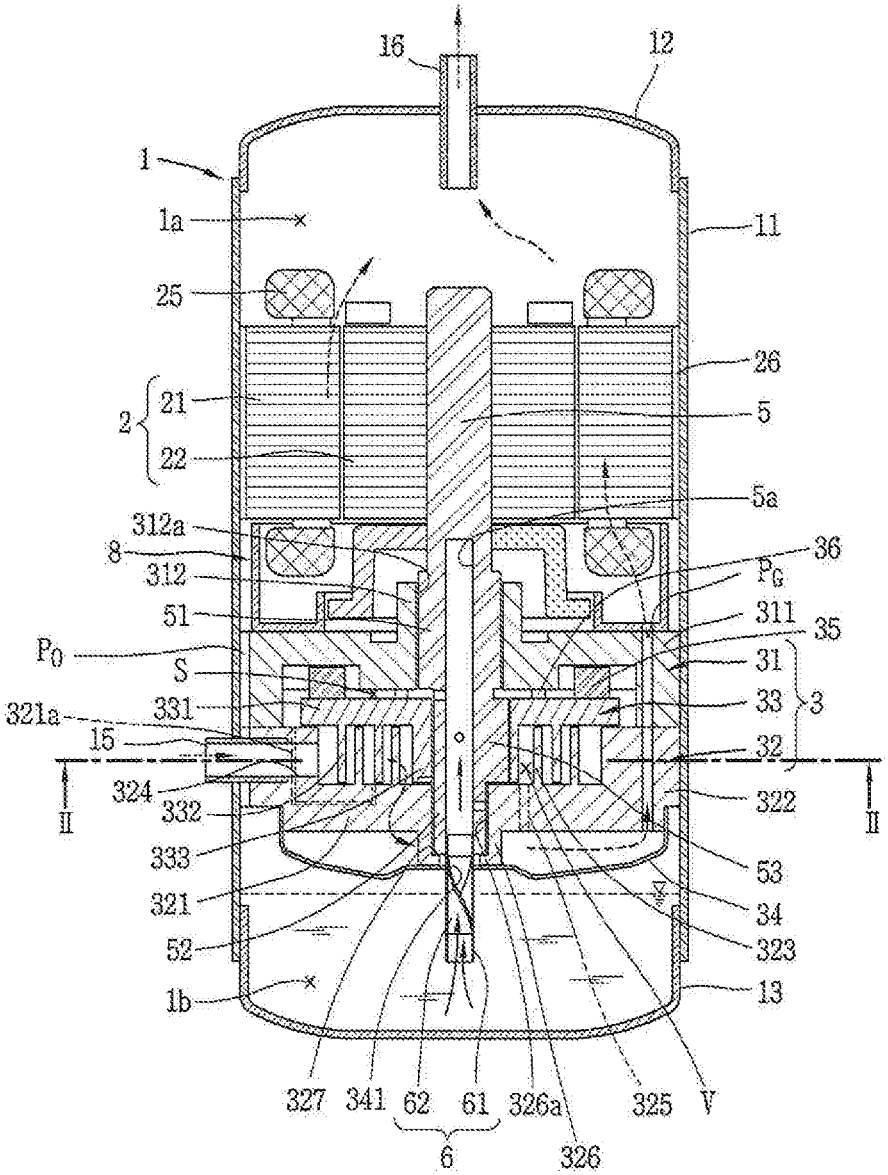
FIG. 1 is a longitudinal cross-sectional view illustrating an example of a lower compression type scroll compressor according to an embodiment.
Figure 2:
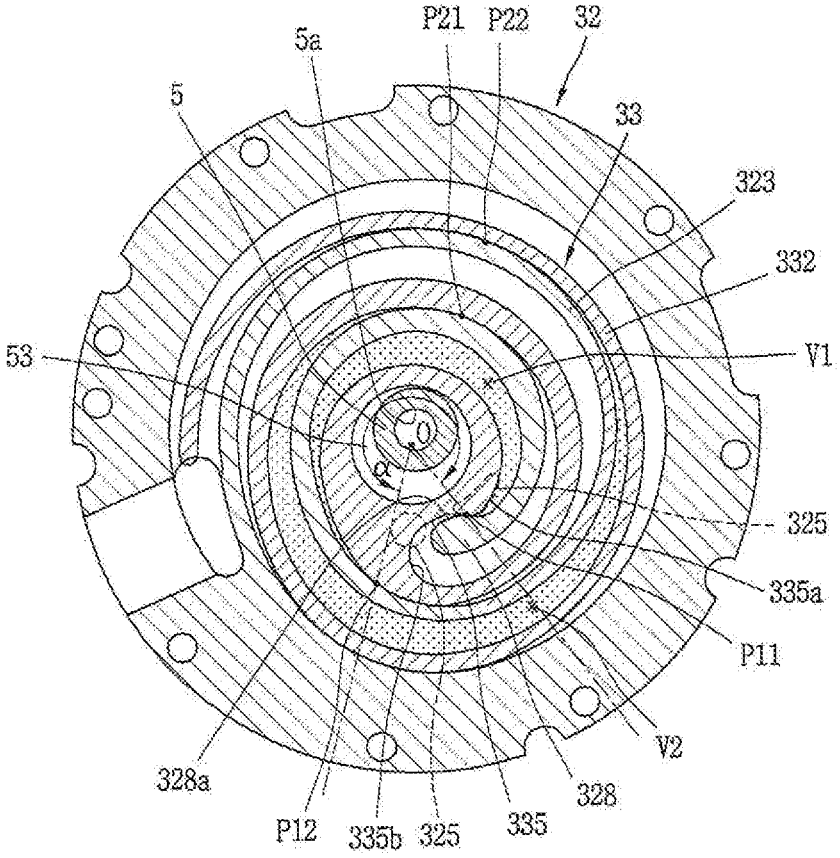
FIG. 2 is a sectional view taken along line 'II-II' in FIG. 1.

FIG. 1 is a longitudinal sectional view illustrating an example of a lower compression type scroll compressor according to an embodiment. FIG. 2 is a sectional view taken along line 'II-II' in FIG. 1.

Referring to FIG. 1, the lower compression type scroll compressor according to this embodiment may include a casing 1 having an inner space 1*a*; a motor part or motor 2 provided at the inner space 1*a* of the casing 1 and configured to generate a rotational force, in the form of a drive motor; a compression part or device 3 disposed or provided below the motor part 2, and configured to compress a refrigerant by receiving the rotation force of the motor part 2. The casing 1 may include a cylindrical shell 11 which forms a hermetic container; an upper shell 12 which forms the hermetic container together by covering an upper part or portion of the cylindrical shell 11; and a lower shell 13 which forms the hermetic container together by covering a lower part or portion of the cylindrical shell 11, and which forms an oil storage space 1*b*.

A refrigerant suction pipe 15 may be penetratingly-formed at a side surface of the cylindrical shell 11, thereby directly communicating with a suction chamber of the compression part 3. A refrigerant discharge pipe 16 that communicates with the inner space 1*a* of the casing 1 may be installed or provided at an upper part or portion of the upper shell 12. The refrigerant discharge pipe 16 may be a passage along which a refrigerant compressed by the compressor part 3 and discharged to the inner space 1*a* of the casing 1 may be discharged to the outside. An oil separator (not shown) that separates oil mixed with the discharged refrigerant may be connected to the refrigerant discharge pipe 16.

A stator 21 which constitutes or forms the motor part 2 may be installed or provided at an upper part or portion of the casing 1, and a rotor 22 which constitutes or forms the motor part 2 together with the stator 21 and rotated by a reciprocal operation with the stator 21 may be rotatably installed or provided in the stator 21. A plurality of slots (not shown) may be formed on an inner circumferential surface of the stator 21 in a circumferential direction, on which a coil 25 may be wound. An oil collection passage 26 configured to pass oil therethrough may be formed between an outer circumferential surface of the stator 21 and an inner circumferential surface of the cylindrical shell 11, in a D-cut shape.

A main frame 31 which constitutes or forms the compression part 3 may be fixed to an inner circumferential surface of the casing 1, below the stator 21 with a predetermined gap therebetween. The main frame 31 may be coupled to the cylindrical shell 11 as an outer circumferential surface of the main frame 31 is welded or shrink-fit to an inner circumferential surface of the cylindrical shell 11.

A ring-shaped frame side wall portion or side wall (first side wall portion or side wall) 311 may be formed at an edge of the main frame 31, and a first shaft accommodating portion 312 configured to support a main bearing portion 51 of a rotational shaft 5, which is discussed hereinafter, may be formed at a central part or portion of the main frame 31. A first shaft accommodating hole 312*a*, configured to rotatably insert the main bearing portion 51 of the rotational shaft 5 and support the main bearing portion 51 in a radial direction, may be penetratingly-formed at the first shaft accommodating portion 312 in an axial direction.

A fixed scroll 32 may be installed or provided at a bottom surface of the main frame 31, in a state in which an orbiting scroll 33 eccentrically-coupled to the rotational shaft 5 is disposed between the fixed scroll 32 and the main frame 31. The fixed scroll 32 may be fixedly-coupled to the main frame 31, and may be fixed to the main frame 31 so as to be moveable in the axial direction.

The fixed scroll 32 may include a fixed plate portion or plate (hereinafter, referred to as a "first plate portion" or first "plate") 321 formed an approximate disc shape, and a scroll side wall portion or side wall (hereinafter, referred to as a "second side wall portion" of "second side wall") 322 formed at an edge of the first plate portion 321 and coupled to an edge of a bottom surface of the main frame 31. A fixed wrap 323, which forms a compression chamber (V) by being engaged with an orbiting wrap 332, which is discussed hereinafter, may be formed on an upper surface of the first plate portion 321. The compression chamber (V) may be formed between the first plate portion 321 and the fixed wrap 323, and between the orbiting wrap 332, which is discussed hereinafter, and the second plate portion 331. The compression chamber (V) may include a suction chamber, an intermediate pressure chamber, and a discharge chamber consecutively formed in a moving direction of the wrap.

The compression chamber (V) may include a first compression chamber (V1) formed between an inner side surface of the fixed wrap 323 and an outer side surface of the orbiting wrap 332, and a second compression chamber (V2) formed between an outer side surface of the fixed wrap 323 and an inner side surface of the orbiting wrap 332. That is, as shown in FIG. 2, the first compression chamber (V1) may be formed between two contact point (P11, P12) generated as the inner side surface of the fixed wrap 323 and the outer side surface of the orbiting wrap 332 come in contact with each other. Under an assumption that a largest angle among angles formed by two lines which connect a center (O) of an eccentric portion with two contact points (P11, P12) is $\alpha$, a formula ($\alpha<360°$) is formed before a discharge operation is started. The second compression chamber (V2) may be formed between two contact points (P21, P22) generated as the outer side surface of the fixed wrap 323 and the inner side surface of the orbiting wrap 332 come in contact with each other.

The first compression chamber (V1) is formed such that a refrigerant is firstly suctioned thereinto prior to being suctioned into the second compression chamber (V2), and such that a compression path thereof is relatively long. However, as the orbiting wrap 332 is formed with irregularity, a compression ratio of the first compression chamber (V1) is lower than a compression ratio of the second compression chamber (V2). Further, the second compression chamber (V2) is formed such that a refrigerant is later suctioned thereinto after being suctioned into the first compression chamber (V1), and such that a compression path thereof is relatively short. However as the orbiting wrap 332 is formed with irregularity, the compression ratio of the second compression chamber (V2) is higher than the compression ratio of the first compression chamber (V1).

A suction opening 324, through which the refrigerant suction pipe 15 and the suction chamber communicate with each other, may be penetratingly-formed at one side of the second side wall portion 322. A discharge opening 325, which communicate with the discharge chamber and through which a compressed refrigerant may be discharged, may be formed at a central part or portion of the first plate portion 321. The discharge opening 325 may be formed in one so as to communicate with both of the first and second compression chambers (V1, V2). Alternatively, a plurality of the discharge opening 325 may be formed so as to communicate with the first and second compression chambers (V1, V2).

A second shaft accommodation portion 326, configured to support a sub bearing portion 52 of the rotational shaft 5, which is discussed hereinafter, may be formed at a central part or portion of the first plate portion 321 of the fixed scroll 32. A second shaft accommodating hole 326*a*, configured to support the sub bearing portion 52 in the radial direction, may be penetratingly-formed at the second shaft accommodating portion 326 in the axial direction.

A thrust bearing portion 327, configured to support a lower end surface of the sub bearing portion 52 in the axial direction, may be formed at a lower end of the second shaft accommodation portion 326. The thrust bearing portion 327 may protrude a lower end of the second shaft accommodating hole 326*a* in the radial direction, towards a shaft center. However, the thrust bearing portion may be formed between a bottom surface of an eccentric portion 53 of the rotational shaft 5, which is discussed hereinafter, and the first plate portion 321 of the fixed scroll 32 corresponding thereto.

A discharge cover 34, configured to accommodate a refrigerant discharged from the compression chamber (V) therein and to guide the refrigerant to a refrigerant passage, which is discussed hereinafter, may be coupled to a lower side of the fixed scroll 32. The discharge cover 34 may be formed such that an inner space thereof may accommodate therein the discharge opening 325 and may accommodate therein an inlet of the refrigerant passage ($P_G$) along which a refrigerant discharged from the compression chamber (V1) may be guided to the inner space 1*a* of the casing 1.

The refrigerant passage ($P_G$) may be penetratingly-formed at the second side wall portion 322 of the fixed scroll 32 and the first side wall portion 311 of the main frame 31, sequentially, at an inner side of an oil passage separation portion 8. Alternatively, the refrigerant passage ($P_G$) may be formed so as to be consecutively recessed from an outer circumferential surface of the second side wall portion 322 and an outer circumferential surface of the first frame 311.

The orbiting scroll 33 may be installed or provided between the main frame 31 and the fixed scroll 32 so as to perform an orbiting motion. An Oldham's ring 35 to prevent rotation of the orbiting scroll 33 may be installed or provided between an upper surface of the orbiting scroll 33 and a bottom surface of the main frame 31 corresponding thereto, and a sealing member 36 which forms a back pressure chamber (S), may be installed or provided at an inner side than the Oldham's ring 35. Thus, the back pressure chamber (S) may be implemented as a space formed by the main frame 31, the fixed scroll 32, and the orbiting scroll 33, outside of the sealing member 36 (second back pressure chamber). The back pressure chamber (S) forms an intermediate pressure because a refrigerant of an intermediate pressure is filled therein as the back pressure chamber (S) communicates with the intermediate compression chamber (V) by a back pressure hole 321*a* provided at the fixed scroll 32. However, a space (first hack pressure chamber) formed at an inner side than the sealing member 36 may also serve as a back pressure chamber as oil of high pressure is filled therein.

An orbiting plate portion or orbiting plate (hereinafter, referred to as a "second plate portion" or "second plate") 331 of the orbiting scroll 33 may be formed to have an approximate disc shape. The back pressure chamber (S) may be formed at an upper surface of the second plate portion 331, and the orbiting wrap 332, which forms the compression chamber by being engaged with the fixed wrap 322, may be formed at a bottom surface of the second plate portion 331.

The eccentric portion 53 of the rotational shaft 5, which is discussed hereinafter, may be rotatably inserted into a central part or portion of the second plate portion 331, such that a rotational shaft coupling portion 333 may pass therethrough in the axial direction.

The rotational shaft coupling portion 333 may be extended from the orbiting wrap 332 so as to form an inner end of the orbiting wrap 332. Thus, as the rotational shaft coupling portion 333 is formed to have a height high enough to be overlapped with the orbiting wrap 332 on a same plane the eccentric portion 53 of the rotational shaft 5 may be overlapped with the orbiting wrap 332 on the same plane. With such a configuration, a repulsive force and a compressive force of a refrigerant may be applied to the same plane on the basis of the second plate portion to be attenuated from each other. This may prevent a tilted state of the orbiting scroll 33 due to the compressive force and the repulsive force.

An outer circumference of the rotational shaft coupling portion 333 may be connected to the orbiting wrap 332 to form the compression chamber (V) during a compression operation together with the fixed wrap 322. The orbiting wrap 332 may be formed to have an involute shape together with the fixed wrap 323. However, the orbiting wrap 332 may be formed to have various shapes. For example, as shown in FIG. 2, the orbiting wrap 332 and the fixed wrap 323 may be formed to have a shape implemented as a plurality of circles of different diameters and origin points may be connected to each other, and a curved line of an outermost side may be formed as an approximate oval having a long axis and a short axis.

A protrusion 328 that protrudes toward an outer circumference of the rotational shaft coupling portion 333, may be formed near an inner end (a suction end or a starting end) of the fixed wrap 323. A contact portion 328*a* may protrude from the protrusion 328. That is, the inner end of the fixed wrap 323 may be formed to have a greater thickness than other parts. With such a configuration, the inner end of the fixed wrap 323, having the largest compressive force among other parts of the fixed wrap 323, may have an enhanced wrap intensity and may have enhanced durability.

A concaved portion 335, engaged with the protrusion 328 of the fixed wrap 323, may be formed at an outer circumference of the rotational shaft coupling portion 333 which is opposite to the inner end of the fixed wrap 323. A thickness increase portion 335*a*, having its thickness increased from an inner circumferential part or portion of the rotational shaft coupling portion 333 to an outer circumferential part or portion thereof, may be formed at one side of the concaved portion 335, at an upstream side in a direction to form the compression chambers (V). This may enhance a compression ratio of the first compression chamber (V1) by shortening a length of the first compression chamber (V1) prior to a discharge operation.

A circular arc surface 335*b* having a circular arc shape may be formed at another side of the concaved portion 335. A diameter of the circular arc surface 335*b* may be determined by a thickness of the inner end of the fixed wrap 323 and an orbiting radius of the orbiting wrap 332. If the thickness of the inner end of the fixed wrap 323, the diameter of the circular arc surface 335*b* is increased. This may allow the orbiting wrap around the circular arc surface 335*b* to have an increased thickness and thus to obtain durability. Further, as a compression path becomes longer a compression ratio of the second compression chamber (V2) may be increased in correspondence thereto.

The rotational shaft 5 may be supported in the radial direction as an upper part or portion thereof is forcibly-coupled to a central part or portion of the rotor 22, and as a lower part or portion thereof is coupled to the compression part 3. Thus, the rotational shaft 5 transmits a rotational force of the motor part 2 to the orbiting scroll 33 of the compression part 3. As a result the orbiting scroll 33 eccentrically-coupled to the rotational shaft 5 performs an orbiting motion with respect to the fixed scroll 32.

The main bearing portion 51, supported in the radial direction by being inserted into the first shaft accommodating hole 312*a* of the main frame 31, may be formed at a lower part or portion of the rotational shaft 5. The sub bearing portion 52, supported in the radial direction by being inserted into the second shaft accommodating hole 326*a* of the fixed scroll 32, may be formed below the main bearing portion 51. The eccentric portion 53, inserted into the rotational shaft coupling portion 333 of the orbiting scroll 33, may be formed between the main bearing portion 51 and the sub bearing portion 52.

The main bearing portion 51 and the sub bearing portion 52 may be formed to be concentric with each other, and the eccentric portion 53 may be formed to be eccentric from the main bearing portion 51 or the sub bearing portion 52 in the radial direction. The sub bearing portion 52 may be formed to be eccentric from the main bearing portion 51.

An outer diameter of the eccentric portion 53 may be formed to be smaller than a diameter of the main bearing portion 51, but larger than a diameter of the sub bearing portion 52, such that the rotational shaft 5 may be easily coupled to the eccentric portion 53 through the shaft accommodating holes 312*a*, 326*a*, and the rotational shaft coupling portion 333. However, in a case of forming the eccentric portion 53 using an additional bearing without integrally forming the eccentric portion 53 with the rotational shaft 5, the rotational shaft 5 may be coupled to the eccentric portion 53, without the configuration that the outer diameter of the eccentric portion 53 is larger than the diameter of the sub bearing portion 52.

An oil supply passage 5*a*, along which oil may be supplied to the bearing portions and the eccentric portion, may be formed in the rotational shaft 5. As the compression part 3 is disposed below the motor part 2, the oil supply passage 5*a* may be formed in a chamfering manner from a lower end of the rotational shaft 5 to a lower end of the stator 21 or to an intermediate height of the stator 21, or to a height higher than an upper end of the main bearing portion 51.

An oil feeder 6, configured to pump oil contained in the oil storage space 1*b*, may be coupled to a lower end of the rotational shaft 5, that is, a lower end of the sub bearing portion 52. The oil feeder 6 may include an oil supply pipe 61 insertion-coupled to the oil supply passage 5*a* of the rotational shaft 5, and an oil suctioning member 62, for example, propeller, inserted into the oil supply pipe 61 and configured to suction oil. The oil supply pipe 61 may be installed or provided to be immersed in the oil storage space 1*b* via a though hole 341 of the discharge cover 34.

An oil supply hole and/or an oil supply groove, configured to supply oil suctioned through the oil supply passage to an outer circumferential surface of each of the respective bearing portions and the eccentric portion, may be formed at the respective bearing portions and the eccentric portion, or at a position between the respective bearing portions. Thus, oil suctioned toward an upper end of the main bearing portion 51 along the oil supply passage 5*a* of the rotational shaft 5, an oil supply hole (not shown) and an oil supply groove (not shown), flows out of bearing surfaces from an upper end of the first shaft accommodating portion 312 of the main frame 31. Then, the oil flows down onto an upper surface of the main frame 31, along the first shaft accommodating portion 312. Then, the oil is collected in the oil storage space 1*b*, through an oil passage ($P_O$) consecutively formed on an outer circumferential surface of the main frame 31 (or through a groove that communicates or extends from the upper surface of the main frame 31 to the outer circumferential surface of the main frame 31) and an outer circumferential surface of the fixed scroll 32.

Further, oil, discharged to the inner space 1*a* of the casing 1 from the compression chamber (V) together with a refrigerant, may be separated from the refrigerant at an upper space of the casing 1. Then, the oil may be collected in the oil storage space 1*b*, through a passage formed on an outer circumferential surface of the motor part 2, and through the oil passage ($P_O$) formed on an outer circumferential surface of the compression part 3.

The lower compression type scroll compressor according to an embodiment may be operated as follows.

Firstly, once power is supplied to the motor part 2, the rotor 21, and the rotational shaft 5 may be rotated as a rotational force is generated. As the rotational shaft 5 is rotated, the orbiting scroll 33 eccentrically-coupled to the rotational shaft 5 may perform an orbiting motion by the Oldham's ring 35.

As a result, the refrigerant supplied from outside of the casing 1 through the refrigerant suction pipe 15 may be introduced into the compression chambers (V), and the refrigerant compressed as a volume of the compression chambers (V) is reduced by the orbiting motion of the orbiting scroll 33. Then, the compressed refrigerant may be discharged to an inner space of the discharge cover 34 through the discharge opening 325.

The refrigerant discharged to the inner space of the discharge cover 34 may circulate at the inner space of the discharge cover 34, thereby having its noise reduced. Then, the refrigerant may move to a space between the main frame 31 and the stator 21, and move to an upper space of the motor part 2 through a gap between the stator 21 and the rotor 22.

The refrigerant may have oil separated therefrom at the upper space of the motor part 2, and then be discharged to the outside of the casing 1 through the refrigerant discharge pipe 16. On the other hand, the oil may be collected in the oil storage space, a lower space of the casing 1, through a flow path between an inner circumferential surface of the casing 1 and the stator 21, and through a flow path between the inner circumferential surface of the casing 1 and an outer circumferential surface of the compression part 3. Such processes may be repeatedly performed.

The compression chamber (V) formed between the fixed scroll 32 and the orbiting scroll 33 may have a suction chamber at an edge region, and may have a discharge chamber at a central region on the basis of the orbiting scroll 33. As a result, the fixed scroll 32 and the orbiting scroll 33 may have a highest temperature at the central region. This may cause the fixed scroll 32 and the orbiting scroll 33 to have severe thermal expansion at the central region. Especially, in a case in which the orbiting scroll 33 is formed of a soft material, such as aluminum, the orbiting scroll 33 may have a larger thermal expansion than the fixed scroll 32, which may be formed of cast-iron. Hereinafter, the orbiting scroll will be discussed.

Figure 3A:
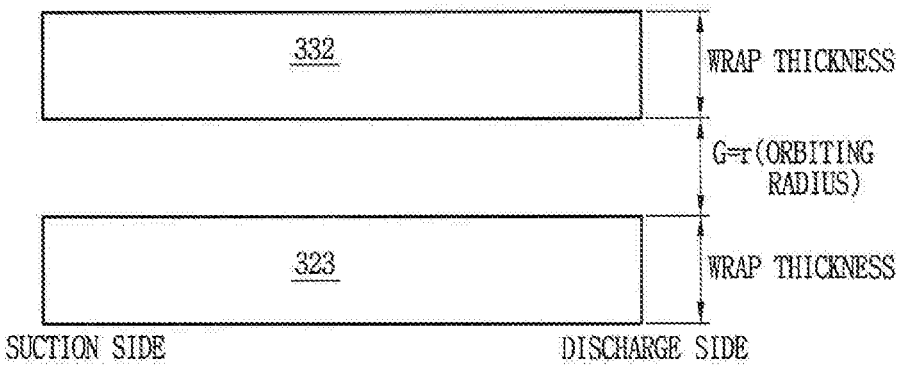
FIGS. 3A and 3B are an unfolded view and a planar view, respectively, which illustrate a wrap thickness in order to explain a partial interference between an orbiting scroll and a fixed scroll in the scroll compressor of FIG. 1.
Figure 3B:
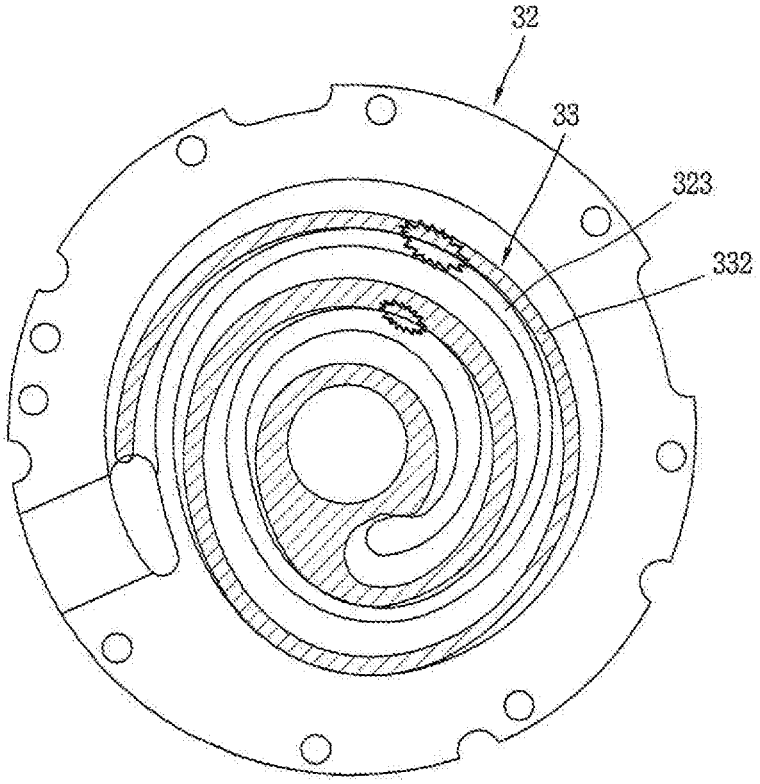

FIGS. 3A and 3B are an unfolded view and a planar view, respectively, which illustrate a wrap thickness in order to explain a partial interference between an orbiting scroll and a fixed scroll in the scroll compressor of FIG. 1, due to thermal expansion of the orbiting scroll. As shown in FIG. 3A, when a gap (G) between the fixed wrap 323 and the orbiting wrap 332 is constant as an orbiting radius, the orbiting wrap 332 and the fixed wrap 323 may interfere with each other at a section. That is, if thermal expansion occurs at the central region of the orbiting scroll 33 having the discharge chamber, the edge region of the orbiting scroll 33 has a total expansion amount obtained by adding an expansion amount at the central region to an expansion amount at the edge region, as the expansion amount is sequentially accumulated from the central region to the edge region. This may cause an expansion amount to be increased toward the edge region.

Accordingly, as shown in FIG. 3B, the edge region may have a point at which a side surface of the orbiting wrap 332 excessively contacts a side surface of the fixed wrap 323 corresponding thereto. This may cause a frictional loss between contact surfaces of the fixed wrap 323 and the orbiting wrap 332. Especially, severe abrasion may occur on the contact surface of the orbiting wrap 332 formed of a soft material. This may cause the orbiting wrap 332 and the fixed wrap 323 to be widened from each other, resulting in refrigerant leakage and a compression loss.

In order to solve such problems, in this embodiment, a wrap interval (or wrap thickness) of the orbiting wrap may be gradually increased from the central region toward the edge region. This may prevent interference between the orbiting wrap and the fixed wrap, even if the orbiting scroll has thermal expansion in the radial direction.

Figure 4:
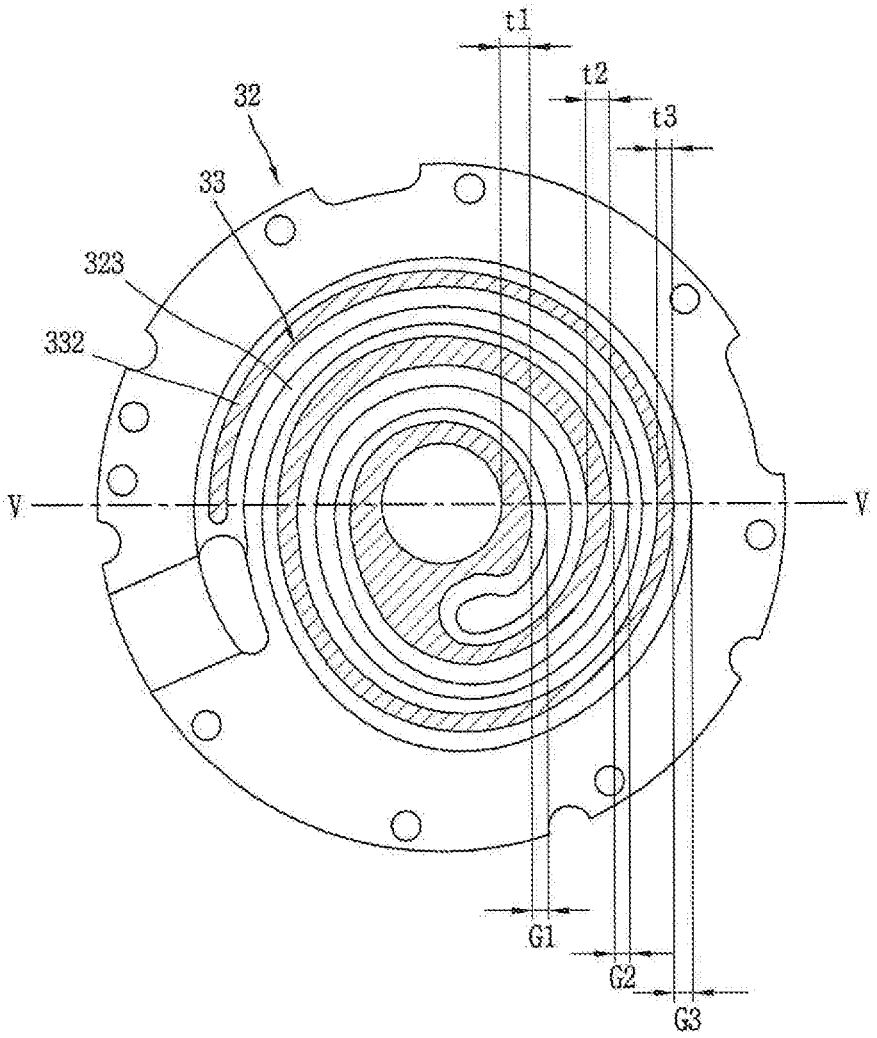
FIG. 4 is a planar view illustrating a state in which a fixed scroll and an orbiting scroll are concentric with each other scroll compressor according to an embodiment.
Figure 5:
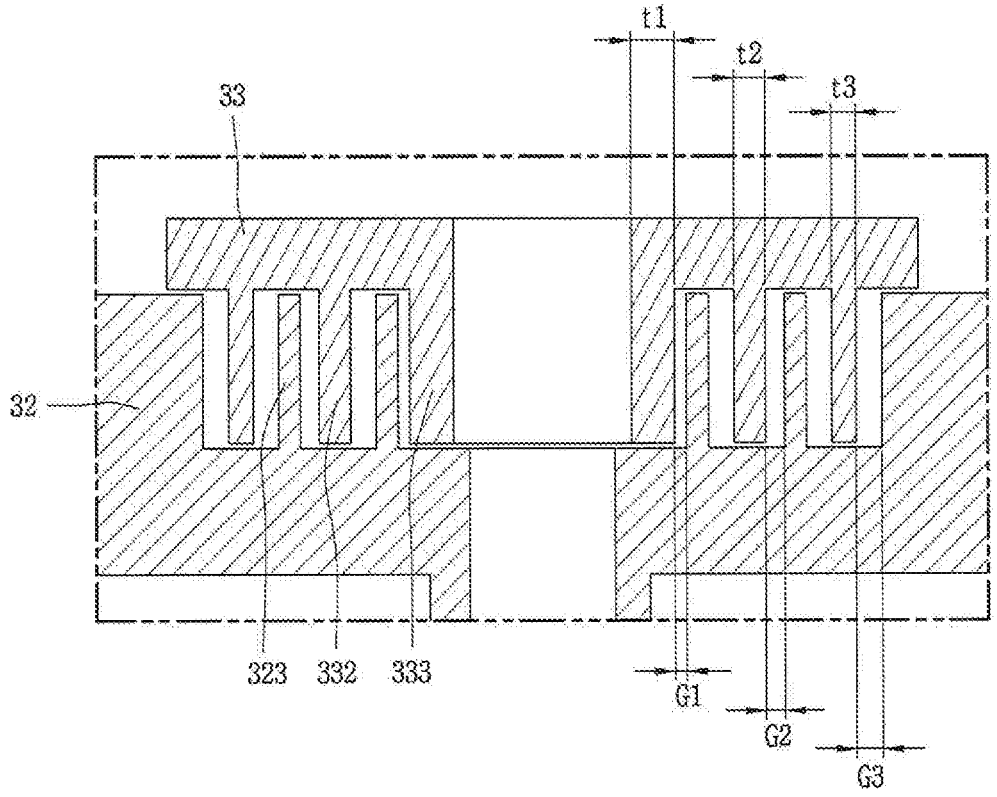
FIG. 5 is a sectional view taken along line 'V-V' in FIG. 4, which is a longitudinal sectional view for explaining a wrap interval in a coupled state of a fixed scroll to an orbiting scroll.

FIG. 4 is a planar view illustrating a state in which a fixed scroll and an orbiting scroll are concentric with each other in a scroll compressor according to an embodiment. FIG. 5 is a sectional view taken along line 'V-V' in FIG. 4, which is a longitudinal sectional view for explaining a wrap interval in a coupled state of a fixed scroll to an orbiting scroll.

As shown in FIG. 4, in a state in which the center (O) of the fixed scroll 32 and a center (O') of the orbiting scroll 33 are consistent with each other or substantially the same, an interval between the fixed wrap 323 and the orbiting wrap 332 will be discussed hereinafter. A wrap interval (G1) between an outer circumferential surface of the rotational shaft coupling portion 333, which forms a central region of the orbiting scroll 33, and a side surface of a neighboring innermost wrap may be smaller than wrap intervals (G2, G3) between the outer circumferential surface of the rotational shaft coupling portion 333 and neighboring outer wraps. In this case, the second wrap interval (G2) may be smaller than the third wrap interval (G3).

For this, a wrap thickness (t1) at the rotational shaft coupling portion 333 may be greater than a wrap thickness (t2) at a neighboring outer side of the rotational shaft coupling portion 333. The wrap thickness (t2) may be greater than a wrap thickness (t3) at an outer side of the rotational shaft coupling portion 333. Accordingly, the wrap intervals (G1, G2, G3) may be increased toward the edge region of the orbiting scroll 33 from the central region. However, in some cases, the wrap intervals may be increased toward the edge region of the orbiting scroll from the central region, in a state in which the wrap thicknesses are constant. Alternatively, the wrap intervals may be increased toward the edge region of the orbiting scroll from the central region, in a state in which the wrap thicknesses are increased toward the edge region.

Figure 6:
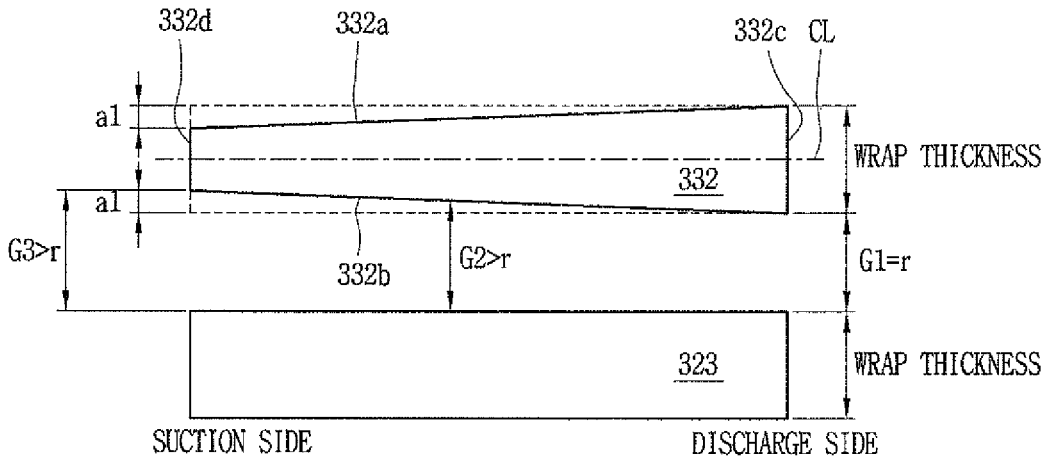
FIG. 6 is an unfolded view illustrating a wrap thickness from an upper side, in order to explain an embodiment to prevent a partial interference between an orbiting scroll and a fixed scroll in the scroll compressor of FIG. 1.

FIG. 6 is an unfolded view illustrating a wrap thickness from an upper side, in order to explain an embodiment to prevent a partial interference between an orbiting scroll and a fixed scroll in the scroll compressor of FIG. 1. As shown in FIG. 6, the orbiting wrap 332 may be offset, such that widths (a1, a1) of two side surfaces 332*a*,332*b* on the basis of a center line (CL) of the orbiting wrap 332 may be decreased toward a suction chamber (Vs) from a discharge chamber (Vd). Accordingly, a wrap thickness (t) of the orbiting wrap 32 may be decreased toward a suction chamber side end 332*d* from a discharge chamber side end 332*c*.

Accordingly, as shown in FIG. 5, the wrap intervals (G1, G2, G3) between the fixed wrap 323 and the orbiting wrap 332 may be gradually increased towards an edge region which forms the suction chamber, from a central region which forms the discharge chamber. That is, the wrap interval between the fixed wrap 323 and the orbiting wrap 332 may be formed as follows. A first wrap interval (G1) formed at a central region of the orbiting scroll 33 (or/and the fixed scroll 32) may be the same as an orbiting radius (r) of the orbiting scroll 33. A second wrap interval (G2) formed between the central region and an edge region, and third wrap interval (G3) formed at the edge region may be larger than the orbiting radius (r) of the orbiting scroll 33. In this case, the third wrap interval (G3) may be larger than the second wrap interval (G2).

With such a configuration, even if thermal deformation of the orbiting wrap is accumulated in the radial direction (a wrap thickness direction) due to thermal expansion towards the edge region from the central region, a gap between the fixed wrap 323 and the orbiting wrap 332 at the edge region may be sufficiently obtained. This may prevent an excessive contact between a side surface of the fixed wrap 323 and a side surface of the orbiting wrap 332 corresponding thereto.

Figure 7:
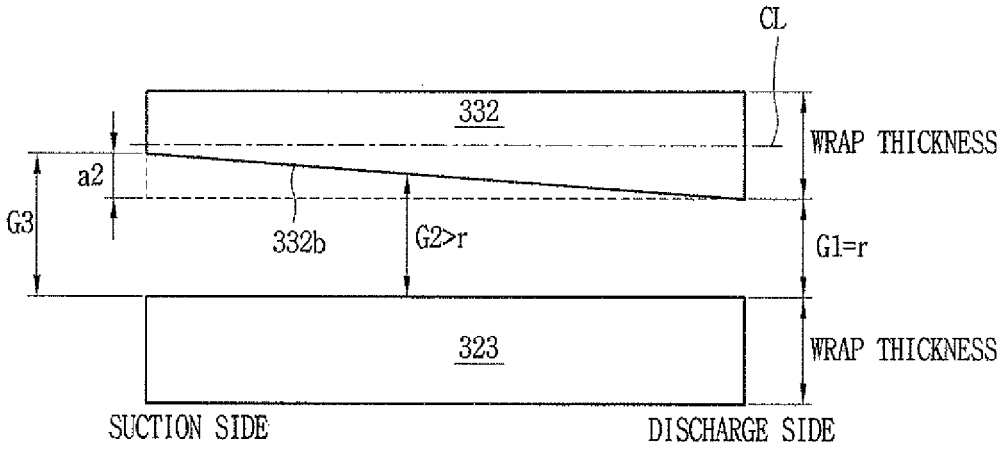
FIGS. 7 and 8 are unfolded views illustrating a wrap thickness from an upper side, in order to explain another embodiment to prevent a partial interference between an orbiting scroll and a fixed scroll in the scroll compressor of FIG. 1.
Figure 8:
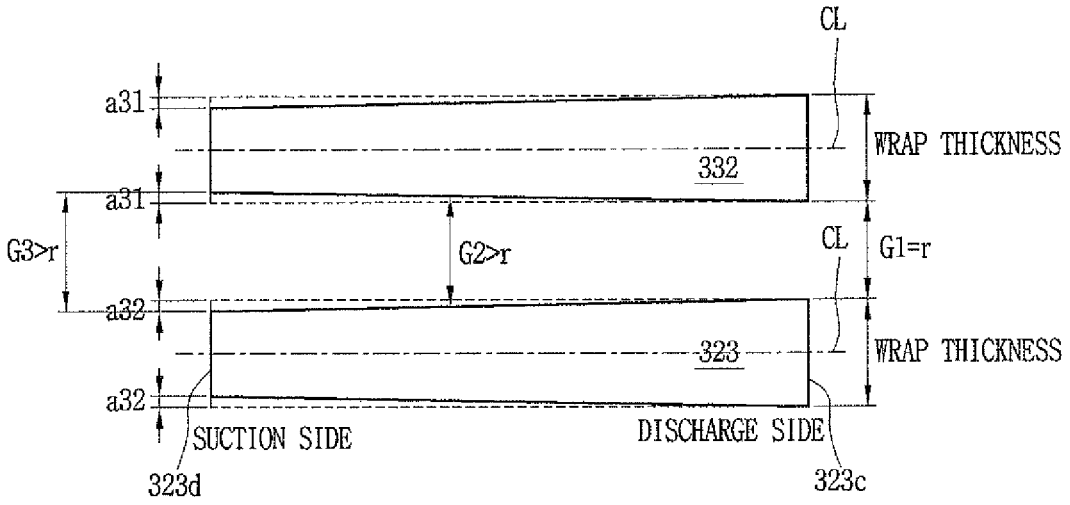

Hereinafter, another embodiment to increase a wrap interval towards an edge region from a central region in a scroll compressor according to an embodiment will be explained. FIGS. 7 and 8 are unfolded views illustrating a wrap thickness from an upper side, in order to explain another embodiment to prevent a partial interference between an orbiting scroll and a fixed scroll in the scroll compressor of FIG. 1.

As shown in FIG. 7, only one side surface 332*b* of the two side surfaces of the orbiting wrap 332 may be offset (a2). However, in this case, another side surface which has not been offset may interfere with a side surface of the fixed wrap 323. In this case, the side surface of the fixed wrap 323 may also be offset. This may prevent a significant decrease of a wrap thickness of the orbiting wrap 332 at a suction chamber side, thereby enhancing reliability.

As shown in FIG. 8, like the orbiting wrap 332, two side surfaces of the fixed wrap 323 may be offset (a31, a32), such that a wrap thickness may be decreased toward a suction chamber side end 323*d* from a discharge chamber side end 323*c*. As a result, a wrap interval (G) between the fixed wrap 323 and the orbiting wrap 332 may be gradually increased towards an edge region from a central region of the orbiting scroll 33 (or/and the fixed scroll). This may prevent a significant decrease of a wrap thickness of the orbiting wrap 332 at a suction chamber side, thereby enhancing reliability.

The orbiting wrap 332 has greater thermal expansion than the fixed wrap 323 even if the fixed wrap 323 and the orbiting wrap 332 are formed of a same material. Considering this, the fixed wrap 323 may be processed such that a wrap thickness thereof may be the same as that according to the original profile. On the other hand, the orbiting wrap 332 may be processed such that a wrap thickness thereof may be smaller than that according to the original profile. In a case in which the orbiting scroll 33 is formed of aluminum whereas the fixed scroll 32 is formed of cast-iron, the wrap thickness of the orbiting wrap 332 may be gradually deceased in a suction side direction, because a thermal expansion coefficient of aluminum is larger than a thermal expansion coefficient of cast-iron by two times approximately.

With such a configuration, interference between the fixed wrap and the orbiting wrap may be prevented, even if a thermal deformation is increased towards an edge region from a central region due to thermal expansion of the fixed scroll or the orbiting scroll while the scroll compressor is being operated, because a gap between the fixed wrap and the orbiting wrap is gradually increased toward the edge region. This may significantly reduce a frictional loss or abrasion due to interference between the fixed wrap and the orbiting wrap.

Further, a limitation in selecting materials of the fixed scroll and the orbiting scroll may be reduced, as interference between the fixed scroll and the orbiting scroll due to a thermal transformation of the fixed wrap or the orbiting wrap is reduced. This may allow a light material to be selected without consideration of a thermal transformation even under a high temperature and a high pressure, resulting in enhanced efficiency. Further, as a thermal transformation of the fixed wrap or the orbiting wrap is reduced, a wrap design suitable for a high compression ratio may be implemented.

Embodiments disclosed herein provide a scroll compressor capable of minimizing a frictional loss or abrasion by preventing interference between a fixed wrap and an orbiting wrap due to thermal expansion. Embodiments disclosed herein further provide a scroll compressor capable of easily selecting materials of a fixed scroll and an orbiting scroll. Embodiments disclosed herein also provide a scroll compressor capable of reducing a limitation in designing a compression ratio.

Embodiments disclosed herein provide a scroll compressor that may include a fixed scroll having a fixed wrap, and an orbiting scroll having an orbiting wrap so as to form a compression chamber by being engaged with the fixed wrap. A wrap interval between the fixed wrap and the orbiting wrap may be increased towards a suction side from a discharge side of a refrigerant. A wrap thickness of the orbiting wrap may be decreased towards a suction side from a discharge side of a refrigerant.

Embodiments disclosed herein provide a scroll compressor that may include a casing; a drive motor provided at an inner space of the casing; a rotational shaft coupled to a rotor of the drive motor, and rotated together with the rotor; a frame provided below the drive motor; a fixed scroll provided below the frame, and having a fixed wrap; and an orbiting scroll provided between the frame and the fixed scroll, having an orbiting wrap so as to form a compression chamber of a suction chamber, an intermediate pressure chamber, and a discharge chamber, by being engaged with the fixed wrap, and having a rotational shaft coupling portion to couple the rotational shaft thereto in a penetrating manner. In a state in which a center of the fixed scroll and a center of the orbiting scroll are consistent with each other or substantially the same, an interval between the fixed wrap and the orbiting wrap may be gradually increased towards the suction chamber from the discharge chamber. A wrap thickness of the orbiting wrap or the fixed wrap may be gradually decreased towards the suction chamber from the discharge chamber.

The orbiting wrap or the fixed wrap may be formed such that widths of two side surfaces thereof on the basis of a center line thereof may be decreased. The orbiting wrap or the fixed wrap may be formed such that a width of one side surface thereof on the basis of a center line thereof may be decreased. The fixed wrap and the orbiting wrap may be formed of different materials. The orbiting wrap may be formed of a softer material than the fixed wrap.

Embodiments disclosed herein provide a scroll compressor that may include a fixed scroll having a fixed plate portion or plate, a fixed wrap that protrudes from the fixed plate portion, a suction opening formed near an outer side end of the fixed wrap, and one or more discharge openings formed near an inner side end of the fixed wrap; and an orbiting scroll having an orbiting plate portion or plate, and having an orbiting wrap that protrudes from the orbiting plate portion and coupled to the fixed wrap, the orbiting wrap which forms a compression chamber including a suction chamber, an intermediate pressure chamber, and a discharge chamber, towards an inner side from an outer side in a wrap moving direction, together with the fixed plate portion, the fixed wrap and the orbiting plate portion while performing an orbiting motion with respect to the fixed wrap. A wrap interval between the fixed wrap and the orbiting wrap may be increased towards the suction chamber from the discharge chamber, in a direction perpendicular to a center line of the fixed wrap or the orbiting wrap.

In a state in which a center of the fixed scroll and a center of the orbiting scroll are consistent with each other or substantially the same, a wrap interval between the fixed wrap and the orbiting wrap may be gradually increased towards the suction chamber from the discharge chamber. The fixed wrap and the orbiting wrap may be formed of different materials. The orbiting wrap may be formed of a softer material than the fixed wrap.

Embodiments disclosed herein provide a scroll compressor that may include a fixed scroll having a fixed plate portion or plate, a fixed wrap that protrudes from the fixed plate portion, a suction opening formed near an outer side end of the fixed wrap, and one or more discharge openings formed near an inner side end of the fixed wrap; and an orbiting scroll having an orbiting plate portion or plate, and having an orbiting wrap that protrudes from the orbiting plate portion and coupled to the fixed wrap, the orbiting wrap which forms a compression chamber including a suction chamber, an intermediate pressure chamber, and a discharge chamber, towards an inner side from an outer side in a wrap moving direction, together with the fixed plate portion, the fixed wrap and the orbiting plate portion while performing an orbiting motion with respect to the fixed wrap. In a state in which a center of the fixed scroll and a center of the orbiting scroll are consistent with each other or substantially the same, the fixed wrap and the orbiting wrap may be formed such that there exists a region in which an interval therebetween in a radial direction is larger than an orbiting radius of the orbiting scroll.

Embodiments disclosed herein provide a scroll compressor that may include a fixed scroll having a fixed plate portion or plate, a fixed wrap that protrudes from the fixed plate portion, a suction opening formed near an outer side end of the fixed wrap; and one or more discharge openings formed near an inner side end of the fixed wrap; and an orbiting scroll having an orbiting plate portion or plate, and having an orbiting wrap that protrudes from the orbiting plate portion and coupled to the fixed wrap, the orbiting wrap which forms a compression chamber including a suction chamber, an intermediate pressure chamber, and a discharge chamber, towards an inner side from an outer side in a wrap moving direction, together with the fixed plate portion, the fixed wrap and the orbiting plate portion while performing an orbiting motion with respect to the fixed wrap. An interval between the fixed wrap and the orbiting wrap at a suction side may be relatively larger than that at a discharge side. The fixed wrap or the orbiting wrap may be formed such that a wrap thickness thereof at a suction side may be relatively smaller than that at a discharge side.

The compression chamber may include a first compression chamber formed on an inner side surface of the fixed wrap, and a second compression chamber formed on an outer side surface of the fixed wrap. The first compression chamber may be defined between two contact points P11 and P12 generated as the inner side surface of the fixed wrap contacts an outer side surface of the orbiting wrap. A formula of $0<\alpha<360°$ may be formed, where $\alpha$ is an angle defined by two lines which connect a center O of the eccentric portion to the two contact points P1 and P2, respectively.

The scroll compressor according to embodiments disclosed herein may have at least the following advantages.

Interference between the fixed wrap and the orbiting wrap may be prevented, even if a thermal deformation is increased towards an edge region from a central region due to thermal expansion of the fixed scroll or the orbiting scroll while the scroll compressor is toeing operated because a gap between the fixed wrap and the orbiting wrap is gradually increased toward the edge region. This may significantly reduce a frictional loss or abrasion due to interference between the fixed wrap and the orbiting wrap.

Further, a limitation in selecting materials of the fixed scroll and the orbiting scroll may be reduced, as interference between the fixed scroll and the orbiting scroll due to a thermal transformation of the fixed wrap or the orbiting wrap is reduced. This may allow a light material to be selected without consideration of a thermal transformation even under a high temperature and a high pressure, resulting in enhanced efficiency. Further, as a thermal transformation of the fixed wrap or the orbiting wrap is reduced, a wrap design suitable for a high compression ratio may be implemented.

Further scope of applicability of the present application will become more apparent from the detailed description given. However, it should be understood that the detailed description and specific examples, while indicating embodiments, are given by way of illustration only, since various changes and modifications within the spirit and scope will become apparent to those skilled in the art from the detailed description.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing;

a drive motor provided at an inner space of the casing;

a rotational shaft coupled to a rotor of the drive motor, and rotated together with the rotor;

a frame provided at one side of the drive motor;

a fixed scroll provided at one side of the frame, and having a fixed wrap;

an orbiting scroll provided between the frame and the fixed scroll, having an orbiting wrap so as to form a compression chamber including a suction chamber, an intermediate pressure chamber, and a discharge chamber, by being engaged with the fixed wrap, and having a rotational shaft coupling portion that couples the rotational shaft thereto in a penetrating manner;

a sealing member provided between the frame and the orbiting scroll, the sealing member configured to form a first back pressure chamber filled with high pressure oil at an inside of the sealing member and a second back pressure chamber that communicates with the intermediate pressure chamber at an outer side of the sealing member; and a discharge cover coupled to the fixed scroll and having an inner space to accommodate a discharge opening provided in the fixed scroll, wherein a wrap thickness of the orbiting wrap continuously gradually decreases towards the suction chamber from the discharge chamber in a range from a discharge side end of the orbiting wrap to a suction side end so that an interval between the fixed wrap and the orbiting wrap continuously gradually increases towards the suction chamber from the discharge chamber in a state in which a center of the fixed scroll and a center of the orbiting scroll are consistent with each other.

2. The scroll compressor of claim 1, wherein the orbiting wrap is formed such that a width thereof decreases as a distance of two side surfaces with respect to a center line decreases.

3. The scroll compressor of claim 1, wherein the orbiting wrap is formed such that a width thereof decreases as a distance of one side surface with respect to a center line decreases.

4. The scroll compressor of claim 1, wherein the fixed wrap and the orbiting wrap are formed of different materials.

5. The scroll compressor of claim 4, wherein the orbiting wrap is formed of a softer material than the fixed wrap.

6. The scroll compressor of claim 1, wherein in a state in which the center of the fixed scroll and the center of the orbiting scroll are consistent with each other, the fixed wrap and the orbiting wrap are formed such that there exists a region at which the interval therebetween in a radial direction is larger than an orbiting radius of the orbiting scroll.

7. The scroll compressor of claim 6, wherein the fixed wrap or the orbiting wrap is formed such that a wrap thickness thereof at a suction side is relatively smaller than a wrap thickness at a discharge side.

8. The scroll compressor of claim 1, wherein an interval between the fixed wrap and the orbiting wrap at a suction side is relatively larger than an interval at a discharge side.

9. The scroll compressor of claim 8, wherein the fixed wrap or the orbiting wrap is formed such that a wrap thickness thereof at a suction side is relatively smaller than a wrap thickness at a discharge side.

10. The scroll compressor of claim 1, wherein the fixed scroll is formed of cast-iron, and orbiting scroll is formed of aluminum.

11. The scroll compressor of claim 1, wherein the fixed wrap and the orbiting wrap are formed of the same material.

12. The scroll compressor of claim 11, wherein a thermal expansion of the orbiting wrap is greater than a thermal expansion of the fixed wrap.

13. A scroll compressor, comprising:

a casing;

a drive motor provided at an inner space of the casing;

a rotational shaft coupled to a rotor of the drive motor, and rotated together with the rotor;

a frame provided at one side of the drive motor;

a fixed scroll provided at one side of the frame, and having a fixed wrap;

an orbiting scroll provided between the frame and the fixed scroll, having an orbiting wrap so as to form a compression chamber including a suction chamber and a discharge chamber, by being engaged with the fixed wrap, and having a rotational shaft coupling portion that couples the rotational shaft thereto in a penetrating manner;

a sealing member provided between the frame and the orbiting scroll, the sealing member configured to form a first back pressure chamber filled with high pressure oil at an inside of the sealing member and a second back pressure chamber that communicates with the discharge chamber at an outer side of the sealing member; and a discharge cover coupled to the fixed scroll and having an inner space to accommodate a discharge opening provided in the fixed scroll, wherein a thermal expansion of the orbiting wrap is greater than a thermal expansion of the fixed wrap, wherein in a state in which the fixed scroll and the orbiting scroll are concentric, an interval between the fixed wrap and the orbiting wrap gradually increases towards the suction chamber from the discharge chamber, the fixed wrap and the orbiting wrap are formed such that there exists a region at which the interval therebetween in a radial direction is larger than an orbiting radius of the orbiting scroll, and wherein a wrap thickness of the orbiting wrap continuously gradually decreases towards the suction chamber from the discharge chamber from a discharge chamber side end of the orbiting wrap to a suction chamber side end.

14. The scroll compressor of claim 13, wherein the fixed wrap and the orbiting wrap are formed of different materials.

* * * * *